United States Patent [19]

Sakurai et al.

[11] Patent Number: 4,790,287

[45] Date of Patent: Dec. 13, 1988

[54] CRANKCASE VENT SYSTEM

[75] Inventors: Kenichi Sakurai, Shizuoka; Kazutoshi Ueda, Iwata, both of Japan

[73] Assignee: Yamaha Hatsudoki Kabushiki Kaisha, Iwata, Japan

[21] Appl. No.: 914,869

[22] Filed: Oct. 3, 1986

[30] Foreign Application Priority Data

Oct. 11, 1985 [JP] Japan ..... 60-226287

[51] Int. Cl.[4] ..... F01M 13/00

[52] U.S. Cl. ..... 123/573; 123/41.86

[58] Field of Search ..... 123/41.86, 572–574

[56] References Cited

U.S. PATENT DOCUMENTS

| | | | |
|---|---|---|---|
| 2,493,617 | 1/1950 | Chubbuck | 123/41.86 |
| 2,797,674 | 7/1957 | Dolza | 123/41.86 |
| 3,949,719 | 4/1976 | Bellanca | 123/41.86 X |
| 4,175,937 | 11/1979 | Brandau et al. | 123/41.86 |
| 4,502,424 | 3/1985 | Katoh et al. | 123/41.86 |
| 4,597,372 | 7/1986 | Furukawa | 123/572 |

*Primary Examiner*—Tony M. Argenbright
*Assistant Examiner*—Eric R. Carlberg
*Attorney, Agent, or Firm*—Ernest A. Beutler

[57] ABSTRACT

A V type engine embodying an improved oil separator for its crankcase ventilation system. The oil separator is contained within the valley between the banks of cylinders and has a simplified but effective arrangement for achieving separation.

7 Claims, 4 Drawing Sheets

CRANKCASE VENT SYSTEM

BACKGROUND OF THE INVENTION

This invention relates to a crankcase vent system, and more particularly to an improved separator for a crankcase ventilation system and an engine embodying such a separator.

The necessity for maintaining adequate ventilation of the crankcase of an internal combustion engine is well known. It is also known that the ventilating gases discharged from the crankcase may contain liquids such as lubricant which should be condensed and returned to the crankcase. This is particularly important where the crankcase ventilating gases are introduced into the engine combustion chambers for further combustion before discharge to the atmosphere. However, the provision of an effective separator or such liquids and for their condensation in the confines of the compact engine have presented substantial problems.

It is, therefore, a principal object of this invention to provide an improved separator for separating lubricants from the crankcase ventilating gases of an internal combustion engine.

It is a further object of this invention to provide an improved, compact, and relatively simple separator for such purposes.

It is a further object of the invention to provide an improved crankcase ventilating system for an internal combustion engine.

SUMMARY OF THE INVENTION

This invention is adapted to be embodied in a separator for separating lubricants from the crankcase ventilating gases of an internal combustion engine. The separator comprises an outer housing and defines an internal cavity that is closed by an upper wall and which is surrounded by a side wall. A discharge conduit extends through the upper wall for discharge of the ventilating gases. A baffle plate affixed at spaced locations to the side wall and is spaced inwardly from the side wall at other locations for admitting crankcase gases to the cavity and for return of condensed liquids to the crankcase of the associated engine.

Another feature of the invention is adapted to be embodied in an internal combustion engine having a crankcase and a chamber positioned above the crankcase. In accordance with this feature of the invention, a separator as described in the preceding paragraph is contained within the upper crankcase chamber so that the lubricant may be returned to the crankcase from the separator.

DETAILED DESCRIPTION OF THE PREFERRED EMBODIMENT

Figure 1:
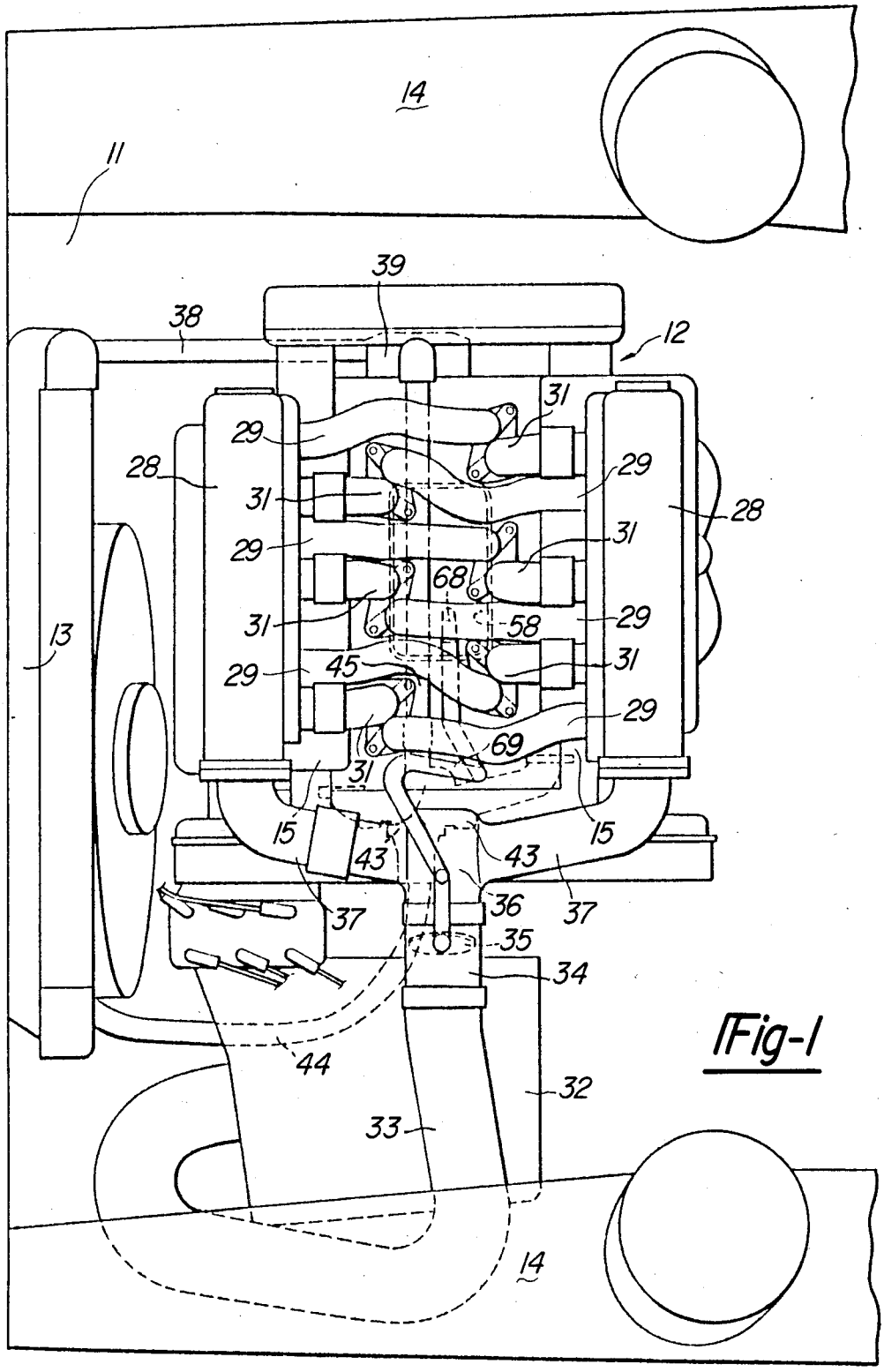
FIG. 1 is a top plan view showing the engine compartment of a motor vehicle powered by an internal combustion engine constructed in accordance with an embodiment of the invention.

Referring first to FIG. 1, an engine compartment of a motor vehicle is identified generally by the reference numeral 11. Positioned within the engine compartment 11 in a transverse location is an internal combustion engine, indicated generally by the reference numeral 12. The engine 12 is disposed with its output shaft extending transversely and is positioned to the rear of a cooling radiator 13 and between the fender aprons 14. The engine 12 drives a pair of front wheels (not shown) in any suitable manner as is normally employed with this type of engine placement.

Deferring now additionally to the remaining figures, the engine 12 includes a cylinder block, indicated generally by the reference numeral 14. The engine 12 is of the V-type and to this end the cylinder block 14 is provided with a pair of angularly related cylinder banks 15. Each of the cylinder banks 15 is formed with a plurality of cylinder bores 16 each of which slidably supports a respective piston 17. The pistons 17 are connected by means of connecting rods 18 to a crankshaft 19. The crankshaft 19 is rotatably journaled within the cylinder block 14 in a known manner, as by means of journals 21.

The cylinder block 14 is provided with a lower flange 22 to which an oil pan or crankcase 23 is affixed, as by bolts 24. The oil pan 23 cooperates with a lower wall 25 of the cylinder block 14 so as to define a crankcase chamber 26. Lubricant is received within the crankcase chamber 26, but the lubricant does not extend above the oil pan 23 so that there is an air volume over the lubricant for ventilating purposes.

A respective cylinder head 27 is affixed to each of the cylinder banks 15. The cylinder head 27 forms combustion chambers with the cylinder bores 16 and piston 17, and an appropriate valve mechanism is provided for admitting an intake charge into each of these combustion chambers and for discharging the burnt charge from the chambers. Since the invention is not concerned with the combustion chambers, neither them nor the valve mechanism associated with them have been illustrated.

The engine 12 is provided with an induction system of the type illustrated and described in the co-pending application entitled "Intake Means of Internal Combustion Engine", Ser. No. 634,795, filed July 26, 1984, now issued as U.S. Pat. No. 4,649,876 on Mar. 17, 1987 and assigned to the Assignee of this application. To this end, there are provided a pair of plenum chambers 28 each of which lies over a respective of the cylinder heads 27. Each plenum chamber has a plurality of long runners 29 that extends across the engine to an inlet port of the opposite cylinder bank and a short runner 31 that extends to an inlet port of the adjacent cylinder bank. Noted in co-pending application Ser. No. 634,795, the runners 29 and 31 are turned so as to provide good performance throughout the entire engine speed and load ranges.

Air is delivered to the respective plenum chambers 28 from an air intake and air filter assembly 32 that is positioned at one end of the engine (FIG. 1). A conduit 33 extends from the air cleaner 32 to an air inlet device 34 in which a single manually operated throttle valve 35 is positioned for controlling the air flow. Downstream of the air inlet device 34, there is provided a distribution device 36 that has a pair of runners 37 which deliver air to the individual plenum chambers 28.

The engine 12 is provided with a cooling system which receives coolant from the radiator 13 through a coolant intake pipe 38. The intake pipe 38 delivers the coolant to an engine driven coolant pump 39 which circulates the engine coolant through a cooling jacket 41 which encircles the cylinder bores 16 and also through similar cooling jackets formed in the cylinder heads 27. The coolant is then discharged through discharge system comprised of a Y type having pair of branches 42 each of which receive coolant from a respective one of the cylinder heads for discharge to a coolant outlet pipe 43 and, in turn, back to the radiator 13 through a coolant return conduit 44. There is further provided a bypass passage 45 that extends from the coolant pump 39 to the return pipe 43 for return to the radiator until the engine has heated sufficiently so as to necessitate full coolant circulation.

Figure 2:
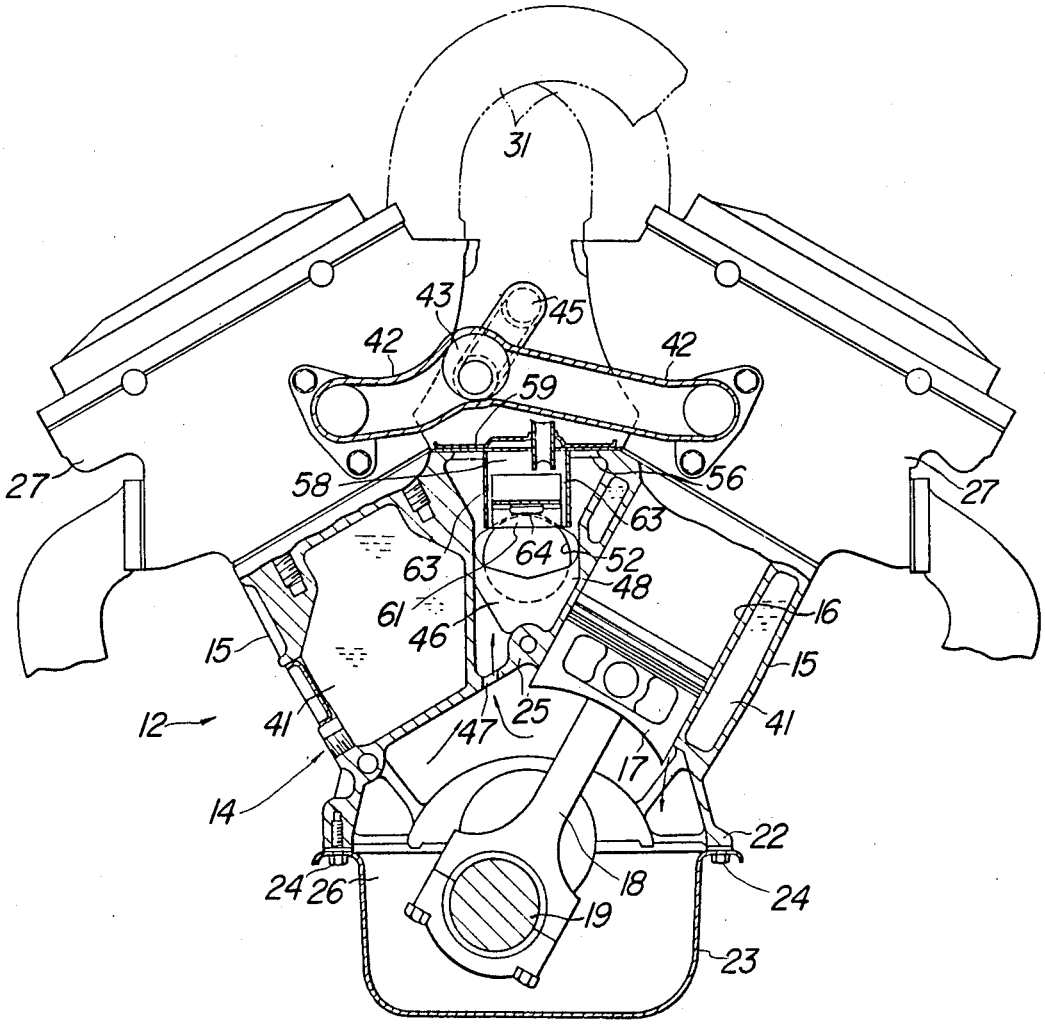
FIG. 2 is a front elevational view of the engine, with portions broken away and other portions shown in sections.
Figure 3:
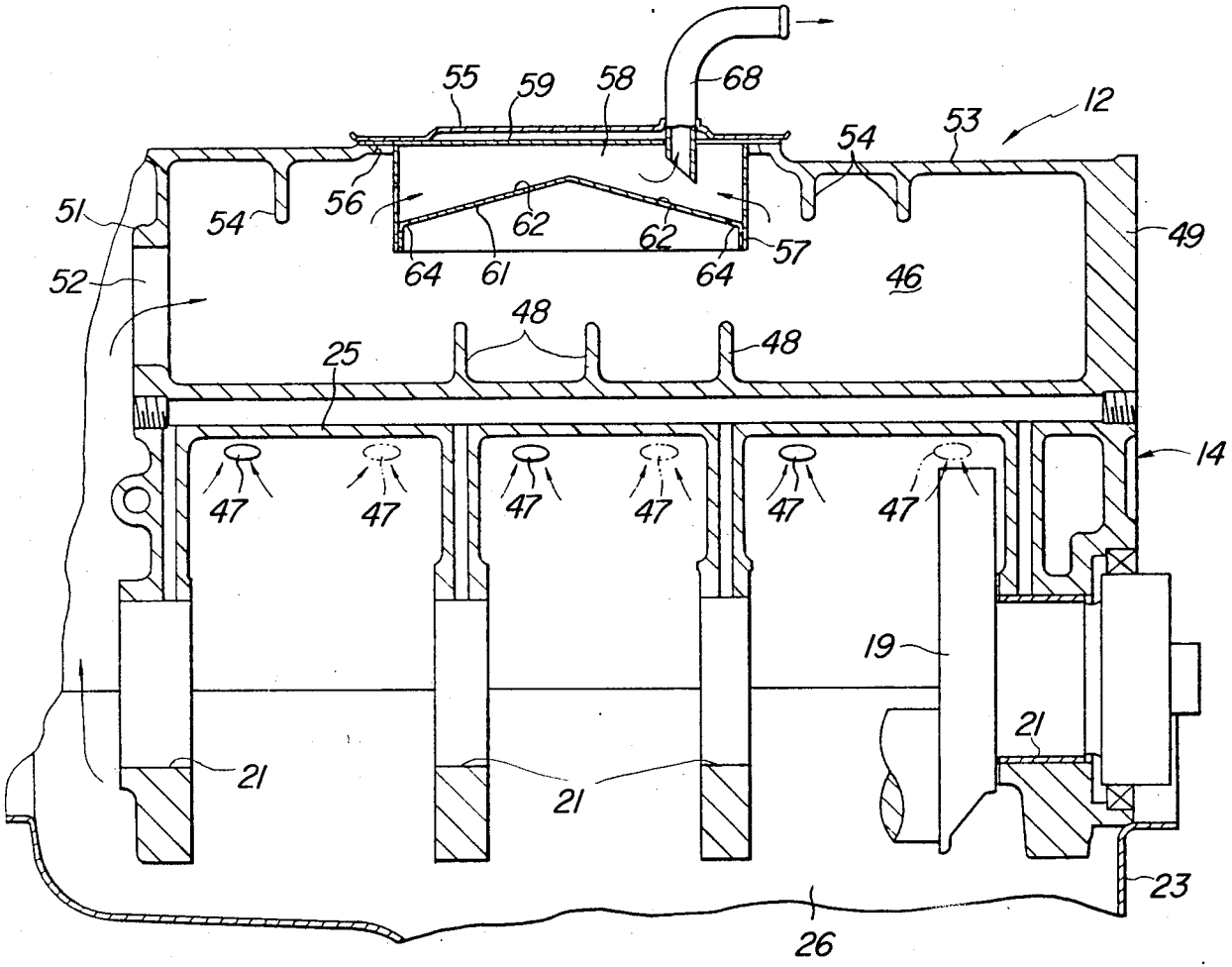
FIG. 3 is a longitudinal, cross-sectional view taken through the engine.
Figure 4:
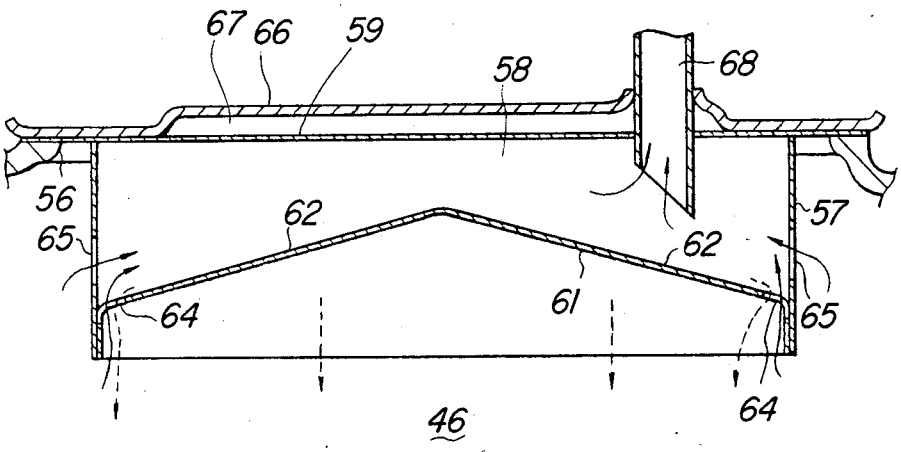
FIG. 4 is an enlarged cross-sectional view, taken along the same plane as FIG. 3, showing the details of the oil separator.

As has been previously noted, the crankcase chamber 26 is provided with an air space over the lubricant for crankcase ventilation. The flow of ventilating air is shown in FIGS. 2 through 4, and it may be seen that the ventilating air passes upwardly into a valley 46 formed between the cylinder banks 15 through a plurality of longitudinally spaced openings 47 formed in the lowermost portion of the cylinder block wall 25. Wall 25 is provided with a plurality of upstanding ribs 48 that will aid in cooling and which will also promote a better air flow through the valley 46.

The valley 46 is further closed at one end by an end wall 49 and at the opposite end by an end wall 51. The end wall 51 has a flow opening 52 so that crankcase gases may flow through this area also as shown in FIG. 3. Upper end of the valley chamber 46 is closed by a top wall 53 of the cylinder block 14. Depending ribs 54 extend into the chamber 46 so as to promote cooling and also to move the airflow through the chamber 46.

The crankcase gases are discharged through a separator, indicated generally by the reference numeral 55. The separator 55 is formed from a plurality of pieces of sheet metal that are connected together and extends through an opening 56 formed in the top wall. The separator 55 comprises a main body portion that is comprised of a generally rectangular-shaped side wall part 57 which defines an internal cavity 58. A top cover plate 59 closes the upper end of the cavity 58. A lower baffle plate 61 partially closes the lower wall of the cavity 59 and has a generally inverted V-shape in cross-section as shown in FIGS. 3 and 4. This shape is made up of a pair of downwardly diverging parts 62 that have their apex at the center of the cavity 58.

As may be seen in FIG. 2, the baffle plate 61 does not extend completely across the width of the cavity 62, so there are spaced gaps 63 formed on the opposite sides which permit air flow in upward direction and the return of condensed liquid back to the crankcase in a lower direction. In addition, there are formed openings 64 at the front and rear sides of the baffle plate 61 where it joins the sidewalls 57 for air flow in an upward direction and condensed oil flow in the downward direction. Adjacent portions of the side wall 57 are also provided with airflow openings 65. The airflow openings 65 are positioned vertically above the baffle plate 62 so no condensed liquid can return to the crankcase through them.

Cover plate 66 overlies the cover plate 59 and defines an air gap 67 therebetween for insulating purposes.

A crankcase ventilating gas air outlet 68 extend through the cover plates 66 and 59 and opens into the cavity 58 for receipt of the crankcase gases from which condensed liquids have been separated. Crankcase discharge pipe 68 communicates with a conduit 69 that delivers the crankcase ventilating gases to the induction system. Crankcase ventilating gases are introduced into the induction system in the manner as shown in the co-pending application entitled "Induction System With E.G.R.", Ser. No. 904,510, filed Sept. 5, 1986, and assigned to the assignee of this application.

It should be readily apparent from the foregoing description that the oil separator is extremely compact in nature, and yet is highly effective in returning condensed liquid back to the crankcase of the engine. Although an embodiment of the invention has been illustrated and described, various changes and modifications may be made without departing from the spirit and scope of the invention as defined by the appended claims.

We claim:

1. An internal combustion engine comprised of a cylinder block having a pair of angularly spaced cylinder banks and defining an upper portion of a crankcase, a chamber formed by said cylinder block between said cylinder banks and separated from said crankcase by an integral lower wall of said cylinder block, opening means formed in said lower wall for communicating said chamber with the crankcase, said cylinder block forming an integral upper wall closing said chamber and having an opening formed therein, and a separator for separating lubricant from the crankcase ventilating gases comprising an outer housing defining an internal cavity closed by an upper wall and surrounded by a sidewall, said outer housing upper wall being supported upon said cylinder block integral upper wall and closing said cylinder block upper wall opening with said separator outer housing side wall depending into said cavity, a discharge conduit extending through said upper wall, and a baffle plate affixed at spaced locations to said sidewall and spaced inwardly from said sidewall at other locations for admitting crankcase gases to said cavity from said chamber and for return of condensed liquids to the crankcase of the associated engine from said chamber.

2. A separator as claimed in claim 1 wherein the baffle plate is inclined to the horizontal, and the lower portion thereof is formed with an opening for returning condensed liquid to the crankcase and for permitting air flow therethrough.

3. A separator as claimed in claim 2 wherein the baffle has an inverted V shape.

4. A separator as claimed in claim 1 wherein there are further openings formed in the sidewall for permitting the flow of air into said separator.

5. A separtor as claimed in claim 4 wherein the sidewalls define a generally rectangular shaped cavity across which the baffle extends.

6. A separator as claimed in claim 5 wherein the baffle plate is inclined to the horizontal, and the lower portion thereof is formed with an opening for returning condensed liquid to the crankcase and for permitting air flow therethrough.

7. A separator as claimed in claim 6 wherein the baffle has an inverted V shape.

* * * * *